US011033945B2

(12) United States Patent
Di Nardo et al.

(10) Patent No.: US 11,033,945 B2
(45) Date of Patent: Jun. 15, 2021

(54) ICE SKATE BLADE BENDING APPARATUS

(71) Applicant: Mayflower Industries, LLC, Kay Largo, FL (US)

(72) Inventors: Thomas Di Nardo, Key Largo, FL (US); Christopher Needham, Midvale, UT (US); Michael Gomm, Provo, UT (US); Chris Lauridsen, Provo, UT (US)

( * ) Notice: Subject to any disclaimer, the term of this patent is extended or adjusted under 35 U.S.C. 154(b) by 276 days.

(21) Appl. No.: 16/338,281

(22) PCT Filed: Sep. 29, 2017

(86) PCT No.: PCT/US2017/054577

§ 371 (c)(1),
(2) Date: Mar. 29, 2019

(87) PCT Pub. No.: WO2018/064616

PCT Pub. Date: Apr. 5, 2018

(65) Prior Publication Data

US 2019/0314880 A1 Oct. 17, 2019

Related U.S. Application Data

(60) Provisional application No. 62/401,597, filed on Sep. 29, 2016.

(51) Int. Cl.
*B21D 7/06* (2006.01)
*B21D 11/10* (2006.01)

(52) U.S. Cl.
CPC ..... *B21D 7/06* (2013.01); *B21D 11/10* (2013.01)

(58) Field of Classification Search
CPC . B21D 7/06; B21D 7/08; B21D 7/085; B21D 7/14; B21D 7/02; B21D 7/04; B21D 11/10; B21D 11/20; B21D 11/22; B21D 5/06; B21D 5/08; B21D 5/14; B21D 43/02; B21D 43/021
USPC ..... 72/458
See application file for complete search history.

(56) References Cited

U.S. PATENT DOCUMENTS 3,420,080 A * 1/1969 Fleming, Jr. ..... B21D 11/06 72/138
3,822,578 A * 7/1974 Le Breton ..... B21D 7/063 72/390.2
9,003,859 B2 * 4/2015 Paris ..... A61B 17/8863 72/362

(Continued)

FOREIGN PATENT DOCUMENTS

WO WO-03000358 A1 * 1/2003 ..... B21D 7/08

*Primary Examiner* — John D Walters
(74) *Attorney, Agent, or Firm* — Dobbin IP Law P.C.; Geoffrey E. Dobbin

(57) ABSTRACT

A skate blade bending apparatus (35) may feature a unitary body (1) with a securement structure (10, 15) which holds a skate blade on its side, parallel to the ground, and a means for exerting downward force (8) on the side of the skate blade. The securement structure may feature movable anvils 15 which will change the imparted radius of curvature imparted upon the blade. Indicia (29) may be utilized to position said anvils (15) to ensure the process is repeatable on different blades. A handle (14) used with the means for exerting downward force (8) may be adjustable. The means for exerting downward force (8) and anvils (15) may be interchangeable with other shapes of similar structures for greater versatility.

8 Claims, 11 Drawing Sheets

(56) References Cited

U.S. PATENT DOCUMENTS 9,872,716 B2 * 1/2018 Cordaro ..... A61B 17/7085

* cited by examiner

ICE SKATE BLADE BENDING APPARATUS

CROSS-REFERENCES TO RELATED APPLICATIONS

The present application claims priority as a U.S. National Phase entry under 35 U.S.C. § 371 of PCT Application PCT/US2017/054577, filed Sep. 29, 2017, which in turn claims priority to U.S. Provisional Application No. 62/401,597, filed Sep. 29, 2016. This Application incorporates both prior applications by reference herein in their entirety.

FIELD OF THE INVENTION

The invention discussed herein relates to the general field of ice-skating accessories and describes a skate blade bending device.

BACKGROUND OF THE INVENTION

The curved speed skate blade was first discussed in U.S. Pat. No. 5,320,368, issued on Jan. 14, 1994, naming Edmund W. Ling as inventor. The patent discusses some of the advantages with longitudinal side bending of speed skating blades and discloses combinations of radius and bend for speed skating blades.

Speed skating blades are generally manufactured with an aluminum or steel longitudinal tubular structure, into which a steel blade is mounted on one side of the tube, and aluminum mounting "cups" or "arms" are attached to the opposite side of the tube to allow for the mounting and adjustment of a boot. There are two general types of speed skating blades, one being designated for short track skating on a 111 m skating track, and the other for long track skating on a 400 m skating track. The short track blades are designed to be mounted in a fixed position at the forefoot and heel of the boot as shown in FIG. 1. The mounts used on the short track blades may be changed for different heights to increase or decrease the distance between the boot and the blade depending on the preference of the skater. The most popular long track blades are designed to be mounted in a fixed position in the forefoot of the blade on a hinged arm (34) that is not fixed to the heel of the boot as shown in FIG. 2A, commonly referred to as a "clap skate" named after the clapping sound that occurs when the hinge closes while skating. FIG. 2B illustrates the movement of the clap arm. This design allows for longer contact with the ice and more speed to be generated by the skater. The hinged clap arm design on the long track skate is not allowed to be used on a short track skate under regulation by the International Skating Union, the governing body for the sport.

Speed skate racing is generally performed with turns only in the counter-clockwise direction. To maximize stability and skating efficiency, skate boots and blades are typically configured to take advantage of the counter-clockwise turns. Blades are mounted on boots with an offset to the left, and some blades are positioned to the left in their support structure. The blade runner surface is also generally adjusted with a radius or "rocker" that complements the dimensions of the skating rink and the experience level of the skater. The radius applied to a beginning skater is normally a single radius, whereas expert level skaters might use a complex curve made of multiple radii varying over the length of the blade surface, also referred to as a compound radius. Typically, the chosen rocker is more curved at the heel and toe areas of the blade, and flatter toward the center of the blade.

The center section of the blade tends to be more curved than the turn radius of the racing course.

In addition to applying a radius to the runner surface of the blade, the blades of expert skaters can be also bent to the left to take advantage of skating only in a counter-clockwise direction. For skaters using a compound radius, the bend applied to the blades can be varied according to the radius to increase the contact area of the blade with the surface of the ice, thereby increasing grip as well as allowing the skater to turn more sharply as they apply weight to that section of the blade. To illustrate this principle, for skaters who have a smaller radius applied to the toe and heel sections of their blades and a flatter radius in the center, when the blades are bent more in the toe and heel areas, as the skater applies more weight to the toe or heel sections of the blade, the blade will turn more quickly allowing the skater to change their trajectory more easily.

The bending of skate blades historically was done with a mallet, vise, or similar tool until the blade "looked right" or "felt right." The bending process was usually applied to the blade's tube, rather than the blade runner because the blade runner is more delicate, and the tube tends to retain the applied curve better. The toe of the blade may be bent so the blade turns more sharply when a skater's weight moves forward. The heel of the blade may be bent so the blade turns more sharply when the skater's weight moves back. The entire blade can be bent in a smooth arc for increased ice contact and stability, or it may have variable curvature to allow the skater to increase or decrease their turning efficiency depending on the portion of blade they apply pressure to. There was little predictability in this process when performed with mallets and vices, and as a result, skaters were often hesitant to skate on blades bent in this manner.

In the mid-1990's, in Australia, Dennis Pennington built a purpose-specific tool for blade bending. The Pennington Blade Bender brought with it a more predictable method of applying the bend to a blade. It allowed the user to apply pressure to a lever arm and flex a portion of the blade between two anvil-like surfaces. The anvils were permanently mounted in a sliding track and could be adjusted for width to increase or decrease the size of the area being bent. Attached to the lever-arm, mounted above the anvils, was a round disk with a radius on the edge, which is like the round surface of the blades tube holder. When the lever was pushed down, the presser disc was pressed against the blade's tube, and a bend in that section of the blade resulted. The more pressure that was applied to the lever arm, the more bend was applied to the blade. The benefits of the Pennington bender included easier repeatability of bending operations, more consistent bending results, the device was portable, and the device was relatively inexpensive.

The Pennington design, which is still in use today, has a main structure which is made of bolted together parts which flex and wear over time because they do not have sufficient torsional rigidity to support the pressure loads applied to the fixture when in use. This results in the device prematurely degrading and becoming unreliable and difficult to use. The shape of the main structure also results in easy contact of the blade runner surface against the frame potentially damaging the blades edge. The shape of the anvils is angular with an area containing a very small radius in the center which the blade tube sits in. When bending a blade beyond the radius of the anvil, the blade's tube contacts the edge of the anvil and the tube is kinked which weakens the strength of the tube and is aesthetically unsightly. The mounting system for the anvils makes adjusting the location of the anvils difficult and does not allow for the use of alternate shaped anvils to accommodate the different tube shapes that are in use on current skate blades, or future skate blades. Additionally, the most current embodiment of the Pennington Bender has a longer lever arm that results in instability when used, in that it causes the bender to tip on the longitudinal plane of the main structure, making the intended use of the bender difficult.

In early 2000, Zandstra Sport B. V. of the Netherlands, released a bender that was designed to be used on the runner surface rather than the blade's tube. It was similar in design to the Pennington Blade Bender in that it used movable anvils and a round presser surface. The Zandstra Blade Bender's anvils were mounted on a bar instead of in a track like the Pennington Bender, and the presser surface was the outer bearing race of a roller bearing assembly. The Zandstra Blade Bender was designed to be used only on long track speed skate blades. The design was for specifically overcoming the difficulty of bending the area under the forefoot section of the blade on long track skates which was very difficult to accomplish because of the stiffness of the hinge mounting structure shown in FIG. 2B. The Zandstra Blade Bender was not designed for use on short track type blades. The anvil mounting design makes it easier to adjust the anvils, but the anvils cannot be replaced with alternate shapes, and the shape of the anvil is flat since it was designed specifically to work on the blade runner and not the tube. The flat design could result in blade damage if too much force was applied to the lever arm.

In 2003, Mr. Michel Beaudoin discussed a new skate bending device in PCT Application number PCT/CA02/00974. Mr. Beaudoin's invention was a significant departure from the Pennington Blade Bender and the Zandstra Blade Bender in that it was more complex. Mr. Beaudoin's design used roller wheels, knobs, levers, hand cranks, and dial indicators, and made it possible to apply smooth bends across the entire length of the blade in one operation. It was also possible to adjust the bend in specific areas of the blade with the Zandstra design. However, in addition to being more complex, the design was heavier, and costlier than other available benders. The design also did not allow for bending long track blades because there was no clearance on the roller wheels for the long track blade's hinge mount mechanism that holds the boot mounting arm. Additionally, the design removed the user's ability to feel how the blade flexed as pressure was applied. Since blades vary from manufacturer to manufacturer, and even from batch to batch by the same manufacturer, merely having a dial indicator number for identifying what the device is doing to the blade is, counter-intuitively, insufficient for providing uniformity in outcome in this scenario. To illustrate this, the Pennington Bender has a facility to install a dial indicator to measure pressure, but very few users ever did so for the reasons mentioned. Furthermore, Mr. Beaudoin's design requires that the blade be separated from the boot to be passed through his machine. This is problematic because much of the set-up for a skaters' skates involves finding a good offset placement for the blade on the boot; when removing the blade from the boot, it is often difficult to get the blade returned to precisely the same location during reassembly. Further, removal and reassembly are time consuming. These factors resulted in the design not being widely adopted.

Accordingly, there exists a need for an improved skate blade bending device.

SUMMARY OF THE EMBODIMENTS

An embodiment of a skate blade bending apparatus for bending a skate blade is presented herein. A skate blade, having a generally elongated configuration, is defined as a blade runner which provides a contacting section for contacting a gliding surface such as ice, and a blade attachment section for attaching the blade to a skate boot. The skate blade also defines a blade longitudinal axis, a blade first side surface, and a blade second side surface. The bending apparatus is comprised of: a one-piece frame; a pressure exerting means attached to the frame for exerting bending pressure on a skate blade in a pressure direction generally perpendicular to the blades longitudinal axis at a predetermined pressure location; an integrated shape within the frame design which allows the user to more precisely apply force to the pressure exerting means, and a blade securing means attached to the frame for locally securing the skate blade so as to allow the bending pressure exerted by the pressure exerting means to bend the skate blade about the pressure location.

Generally, the blade securing means is a pair of longitudinally adjustable restraining locations which are positioned opposite the pressure location in a vertical orientation. The securing means can be adjusted to specify the area upon which pressure will be applied to the skate blade's longitudinal plane. When pressure is applied to the pressure location, on the blade attachment section of the skate blade, the securing means locally restrains blade movement of the skate blade, generally parallel to the pressure direction, allowing for the skate blade to deflect in a perpendicular direction between the blade restraint locations. The result of the securing action and blade deflection allows for the bending of the skate blade. The securing means allows for movement of the skate blade along the blade attachment surface during the application of pressure allowing for precise application of bending pressure without damage to the blade attachment surface.

Accordingly, several advantages of one or more aspects are as follows: to provide a blade bending apparatus that provides an easy, convenient, and repeatable method to bend skate blades of various shapes and configurations, that does not damage the skate blades, that is easily adjusted for bending operation and user configuration preferences, that is easily transported, and that has an attractive appearance. Other advantages of one or more aspects will be apparent from a consideration of the drawings and ensuing description.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in many ways. Also, it is to be understood that the phraseology and terminology employed herein are for description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Figure 1:
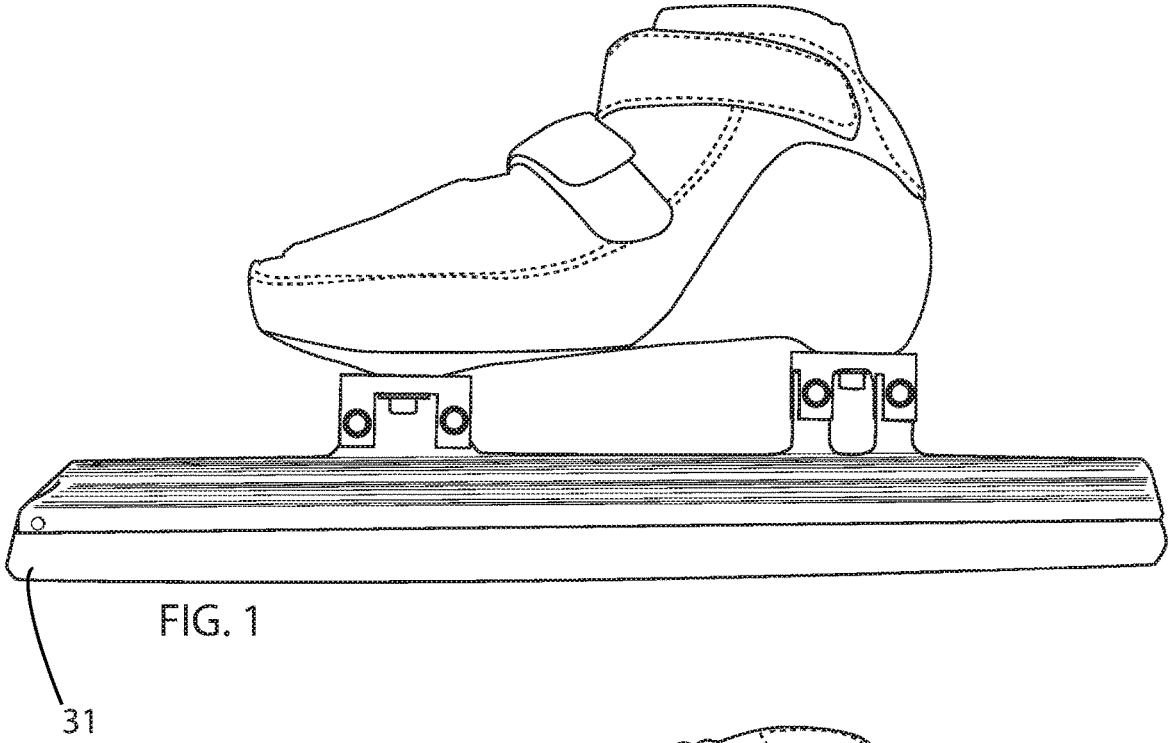
FIG. 1 is a side view of a short track speed skate.

The various embodiments described herein are not intended to limit the invention to those embodiments described. On the contrary, the intent is to cover some possible alternatives, modifications, and equivalents as may be included within the spirit and scope of the invention as defined by the appended claims.

DRAWINGS—LIST OF REFERENCE NUMERALS

The following reference numerals are employed in the figures to indicate the associated elements of the embodiments depicted:

1 Main Body
2 Main Body Bearing (Rear)
3 Main Assembly Pin
4 Main Body Bearing (Front)
5 Lever Arm Mount Washer
6 Lever Arm Mount
7 Dowel Pin
8 Presser Wheel
9 Presser Wheel Bearing
10 Presser Wheel Assembly
11 Presser Wheel Assembly Pin
12 Lever Arm
13 Lever Arm Handle
14 Lever Arm Assembly
15 Anvil
15*a* Alternate Anvil
15*b* Second Alternate Anvil
16 Main body Foot
17 Dowel Pin Hole
18 Main Assembly Pin Hole
19 Presser Wheel Assembly Pin Hole
20 Lever Arm Hole
21 Main Assembly Pin Alignment Slot
22 Anvil Retention Pin
23 Anvil Track
24 Anvil Retention Slot
25 Anvil Install Relief Point
26 Presser Wheel Assembly Pin Tool Hole
27 Recessed Area
28 Hand Grip Rail
29 Graduation Marks
30 Tool Fitting Area
31 Short Track Skate Blade
32 Long Track Skate Blade
33 Blade Rail Support (Tube)
34 Clap Skate Hinge Arm
35 Blade Bending Apparatus

DETAILED DESCRIPTION OF THE PREFERRED EMBODIMENTS

With reference now to the drawings, a preferred embodiment of the skate bending apparatus is herein described. It should be noted that the articles "a", "an", and "the", as used in this specification, include plural referents unless the content clearly dictates otherwise.

Figure 2A:
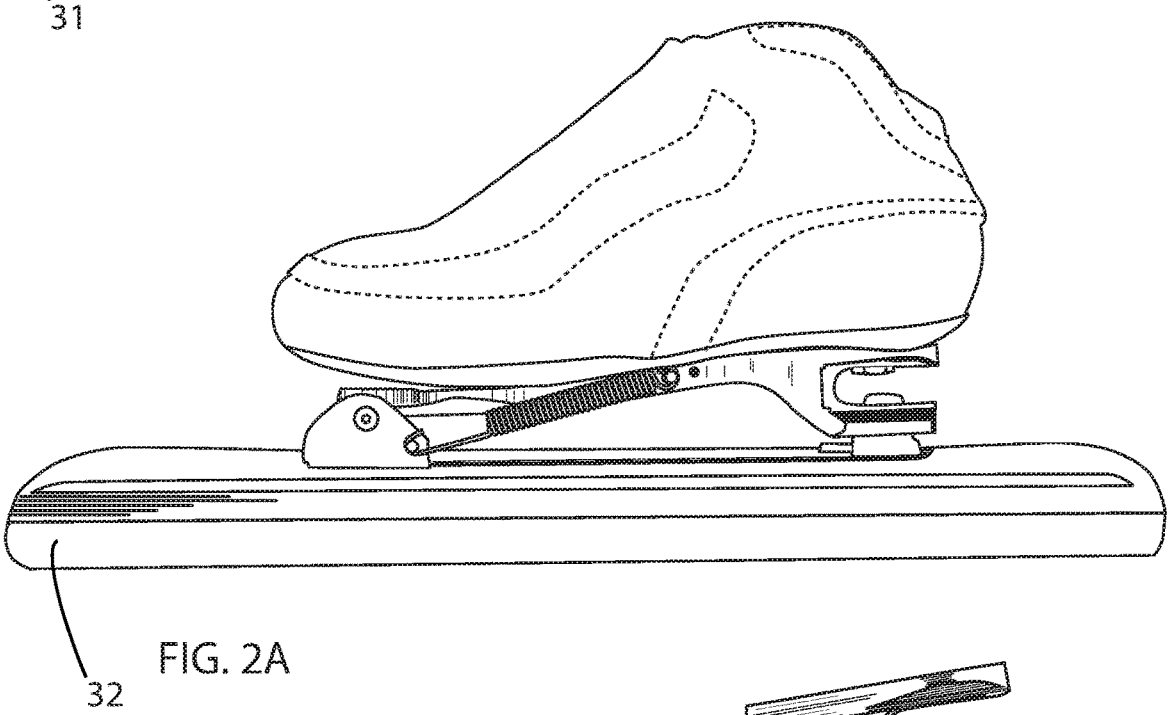
FIG. 2A is a side view of a long track speed skate illustrating the hinged "clap arm" mechanism which is affixed to the forefoot area of the boot.
Figure 2B:
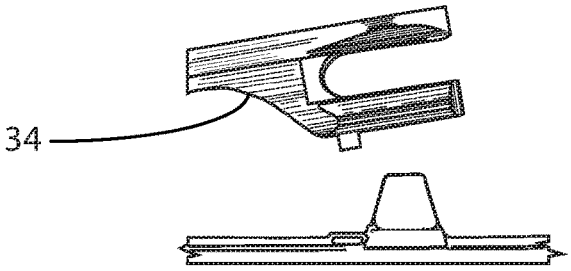
FIG. 2B is a side view of a long track speed skate illustrating the movement of the hinged "clap arm" mechanism.
Figure 3:
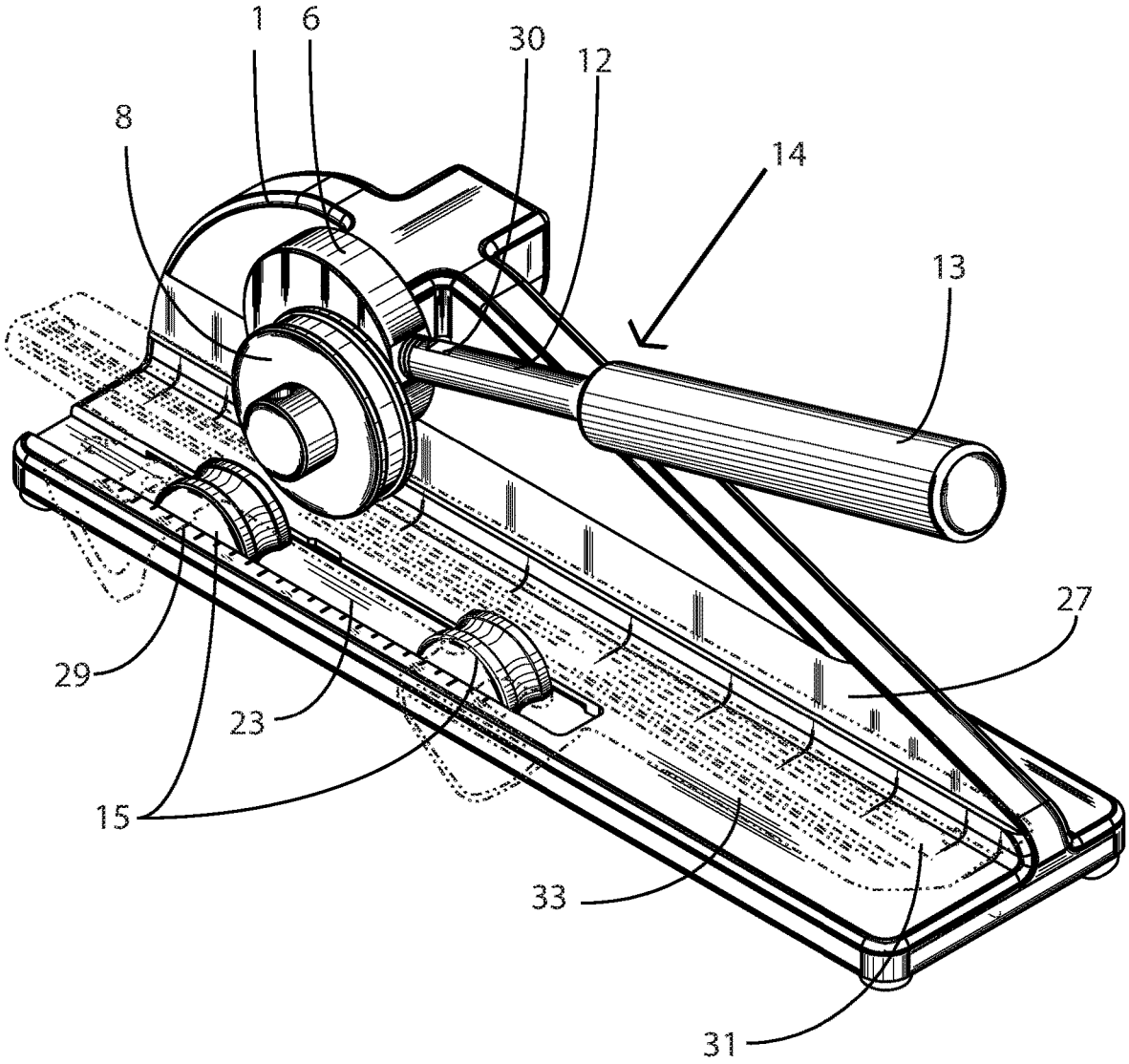
FIG. 3 is a perspective view of the front of a fully assembled skate blade bending apparatus in accordance with an embodiment of the invention.
Figure 4:
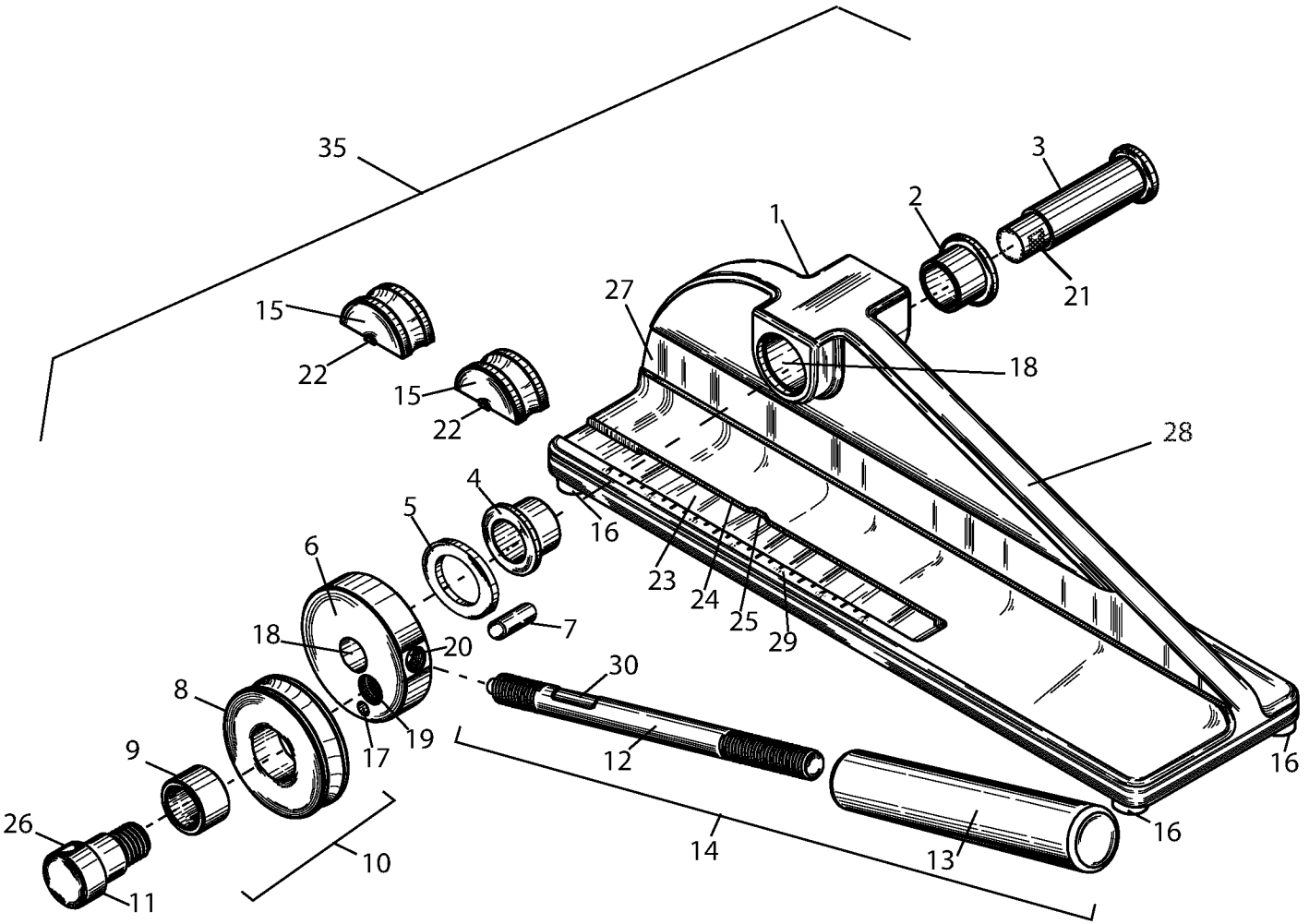
FIG. 4 is an exploded front perspective view of a skate blade bending apparatus in accordance with an embodiment of the invention.
Figure 5:
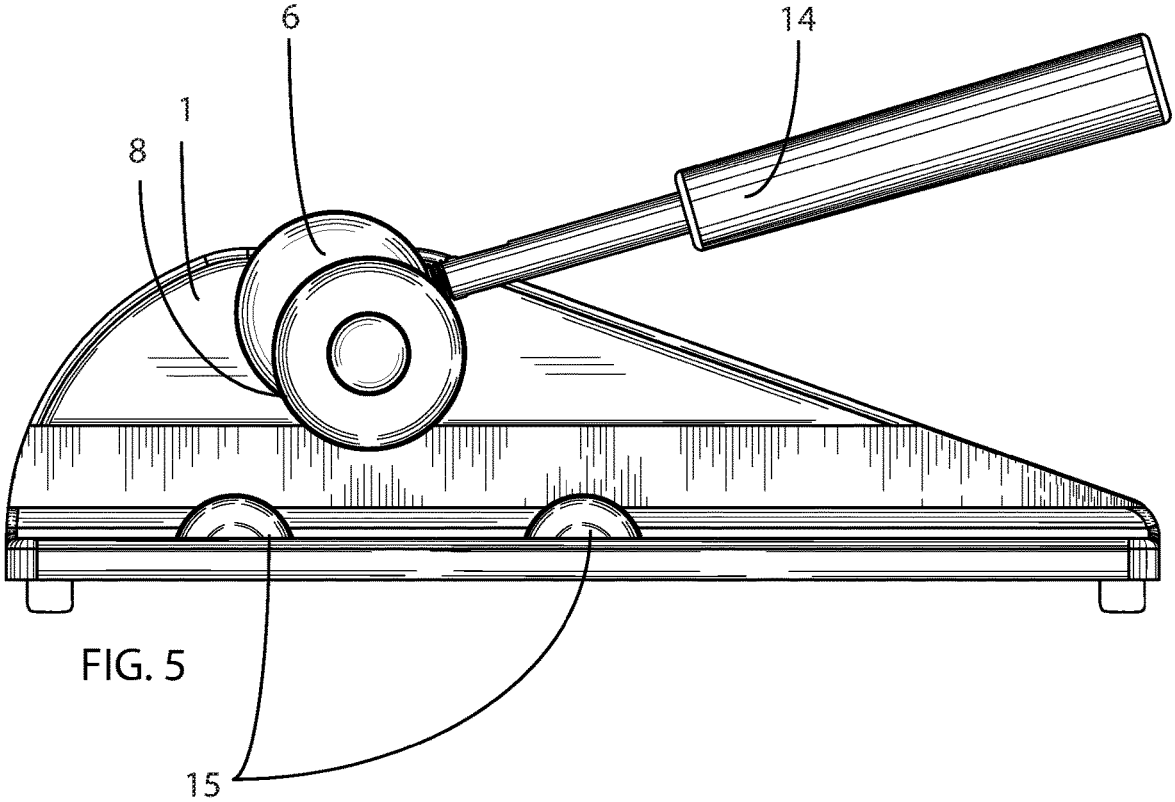
FIG. 5 is a view of the front of a fully assembled skate blade bending apparatus in accordance with an embodiment of the invention.

With reference to FIGS. 3 and 4, a preferred but exemplary embodiment of a blade bending apparatus is shown. The depicted bending apparatus can be used for bending a short track skate blade (31) or a long track skate blade (32), examples of which are shown in FIGS. 1 and 2A. The skate blades (31) and (32) are generally configured with an elongated rail-type support (33), which is typically a cylindrical tube shape with appendages to facilitate mounting of a blade runner component and mounting points for affixing boots, commonly referred to as a blade tube. The blade tube generally has a slot adapted to hold and retain the upper portion of the blade or runner on one side of the blade tube, and mounting platform(s) referred to as "cups" or "arms" attached on the opposite side of the blade tube for attaching the blade assembly to boots. The short track blade (31) and long track blade (32) shown in FIGS. 1 and 2A exemplify one possible embodiment of each type of skate blade bendable with the blade bending apparatus. Various other types of skate blades, including blades of various configurations, may be used without departing from the scope of the present invention. Additionally, blade attachment sections with and without the associated runner or attachment components installed can also be used without departing from the scope of the present invention.

The skate blade bending apparatus is shown in an exploded view in FIG. 4. A main body bearing (rear) (2) and a main body bearing (front) (4) are inserted into a main body (1). A main assembly pin (3) is inserted into the main body (1). A lever arm mount washer (5) is placed onto the main assembly pin (3). A dowel pin (7) is inserted into dowel pin hole (17) in a lever arm mount (6). A lever arm (12) is installed into a lever arm handle (13) to form an adjustable lever arm assembly (14). The lever arm mount (6) is installed onto the main assembly pin (3) such that lever arm hole (20) is aligned with main assembly pin alignment slot (21). The adjustable lever arm assembly (14) is installed into the lever arm mount (6) at lever arm hole (20) until it is tightened against main assembly pin alignment slot (21). A presser wheel bearing (9) is installed into a presser wheel (8) to form a presser wheel assembly (10). Attach the presser wheel assembly (10) to the lever arm mount (6) by inserting a presser wheel assembly pin (11) through the presser wheel bearing (9) and into presser wheel assembly pin hole (19). Install one main body foot (16) on the bottom of each corner of the main body (1). Install two anvils (15) onto the main body (1) by inserting an anvil retention pin (22) of each anvil (15) into the anvil retention slots (24) of the anvil track (23) at the anvil install relief point (25). A line of graduation marks (29) is placed adjacent to anvil track (23) to assist with placement and use of the anvils (15). A recessed area (27) on the face of the main body aids in preventing contact between the skate blade runner surface and the main body (1).

We presently contemplate that the main body (1) of this embodiment be made of aluminum and Computerized Numerical Control machined from a solid block of material, but other materials and methods are also suitable including, but not limited, to alloys, plastics, composites such as carbon fiber, etc.

We presently contemplate that the bearings (2), (4), and (9) be made of bronze and solid in design, but other materials are suitable as are other types of bearings including ball, needle, etc.

We presently contemplate that the lever arm (12), the lever arm mount (6), the dowel pin (7), the presser wheel assembly pin (11), and the main assembly pin (3) be made of steel, but other materials also suitable.

We presently contemplate that the lever arm handle (13) be made of plastic, but other materials are also suitable.

We presently contemplate that lever arm assembly (14) can be adjusted to increase or decrease the effective length of the lever arm by using threaded component parts (12) and (13), but other mechanisms such as set screws, spring loaded detent assemblies, servo motors, etc. are also possible.

We presently contemplate that the presser wheel assembly (10) be operated manually with the lever arm assembly (14), but other mechanically controlled means of delivering force through the presser wheel assembly (10) would also be suitable, including but not limited to, pneumatic, hydraulic, and screw driven mechanisms.

We presently contemplate that the anvil(s) (15, 15*a*, 15*b*) be made of heat-treated steel, but other materials are also suitable.

We presently contemplate that the main body feet (16) be made of rubber and affixed with threaded fasteners, but other materials and fastening mechanisms are suitable.

We presently contemplate that the recessed area (27) include a thin protective rubber coating to further protect against damage to the blade runner surface, but other materials such as PTFE, urethane, silicone, etc. are also suitable. Further, the addition of this coating can be considered optional but beneficial.

We presently contemplate that the graduation marks (29) be etched into the aluminum surface of main body (1), but these marks can also be included by CNC machining, screen printing, surface labeling, etc., or other suitable means. Further, the graduation marks are purely for making the procedure a repeatable process and they can be designated by letters, numerals, or other symbols as appropriate.

The blade bending apparatus achieves its results in the following ways (FIGS. 3, 14-16):

The user first locates two positionable anvils (15) along the anvil rail track (23) with each anvil (15) placed on opposing sides of the centerline of presser wheel (8). Graduation marks (29), are used to choose repeatable positions for placement of the anvils (15) to achieve the user's desired result. After positioning the anvils (15), a skate blade can be inserted between the anvils (15) and the presser wheel (8) orientated so that the blade runner is facing recessed area (27), and the blade tube (33) is positioned atop the anvils (15) with the area of the blade to be bent centered under the presser wheel (8).

The user of the blade bending apparatus applies a bending force to a skate blade tube in a horizontal plane by the user applying pressure to the adjustable lever arm assembly (14), which in turn presses the presser wheel assembly (10) against the skate blade tube (33) in the user specified area. The two positionable anvils (15), are placed on opposite sides of the center line of the presser wheel (8) in user determined locations. The two positionable anvils (15) support the underside of the skate blade tube (33) as well as preventing horizontal movement during the application of pressure. The further apart the two positionable anvils (15) are placed, the broader the area of the skate blade tube is bent. The closer together the two positionable anvils (15) are placed, the narrower an area of the skate blade tube is bent.

Figure 7:
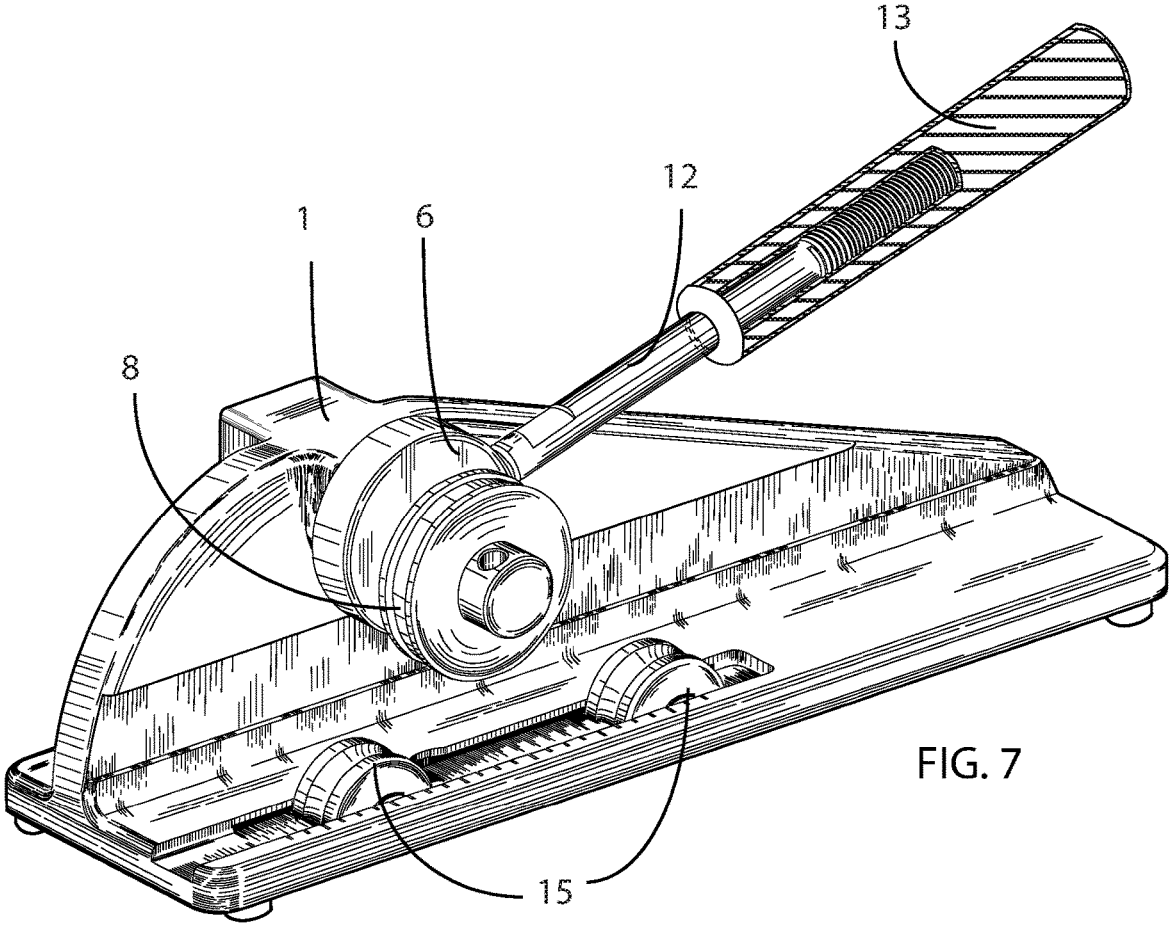
FIG. 7 is an alternate perspective view of the front of a fully assembled skate blade bending apparatus detailing a potential method of adjustment of the variable length lever arm in accordance with an embodiment of the invention
Figure 6:
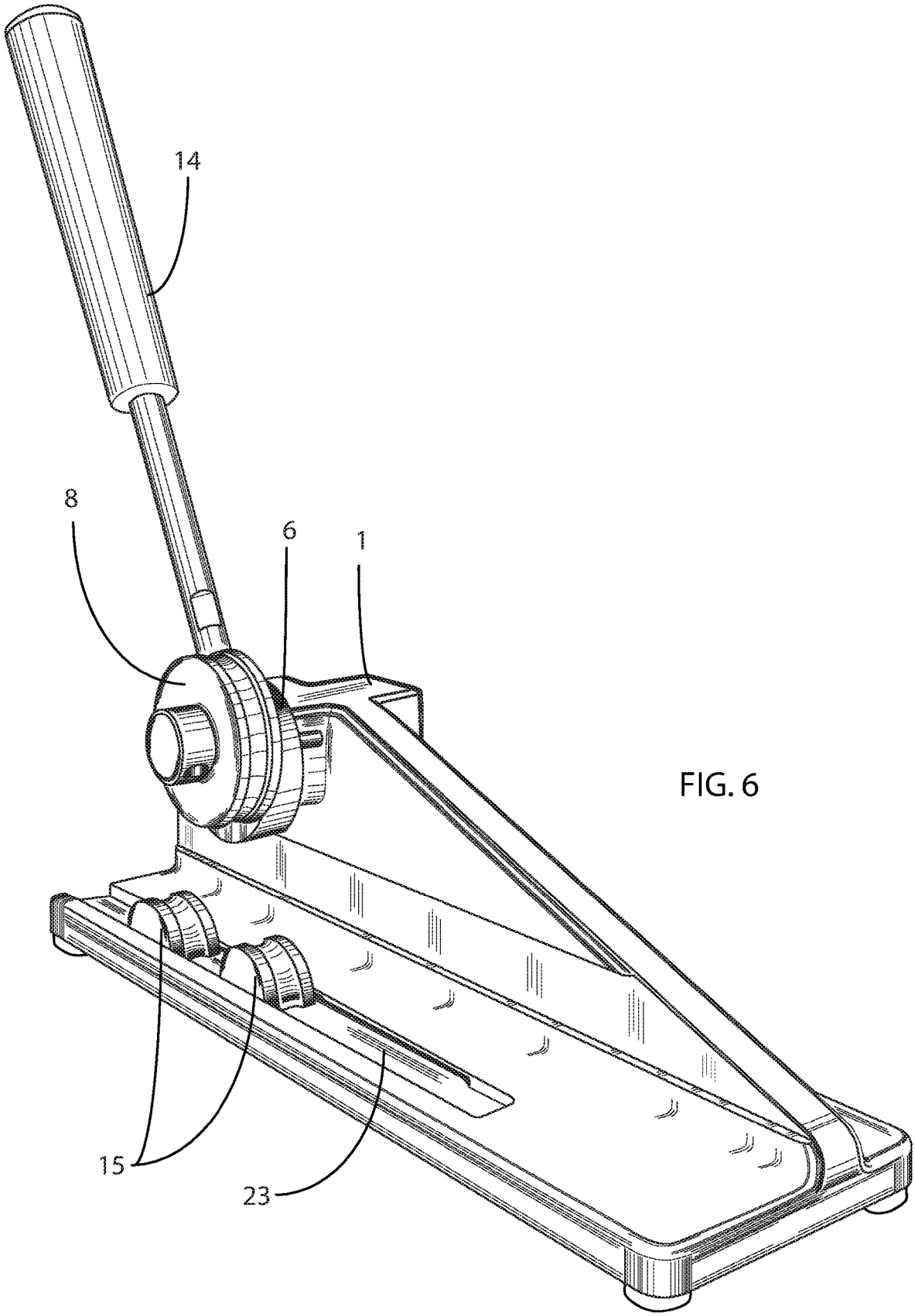
FIG. 6 is an alternate perspective view of the front of a fully assembled skate blade bending apparatus with the lever arm raised in accordance with an embodiment of the invention.

In the preferred embodiment, the user can increase or decrease the adjustable lever arm assembly (14) length to adjust the amount of force generated by the lever arm. The adjustable lever arm assembly (14) length is adjusted by placing a suitable tool on tool fitting area (30) on the lever arm (12), and then turning lever handle (13). Turning lever handle (13) clockwise will decrease the length of the assembly. Turning lever handle (13) counter-clockwise will increase the length of the assembly (FIG. 7).

Figure 8:
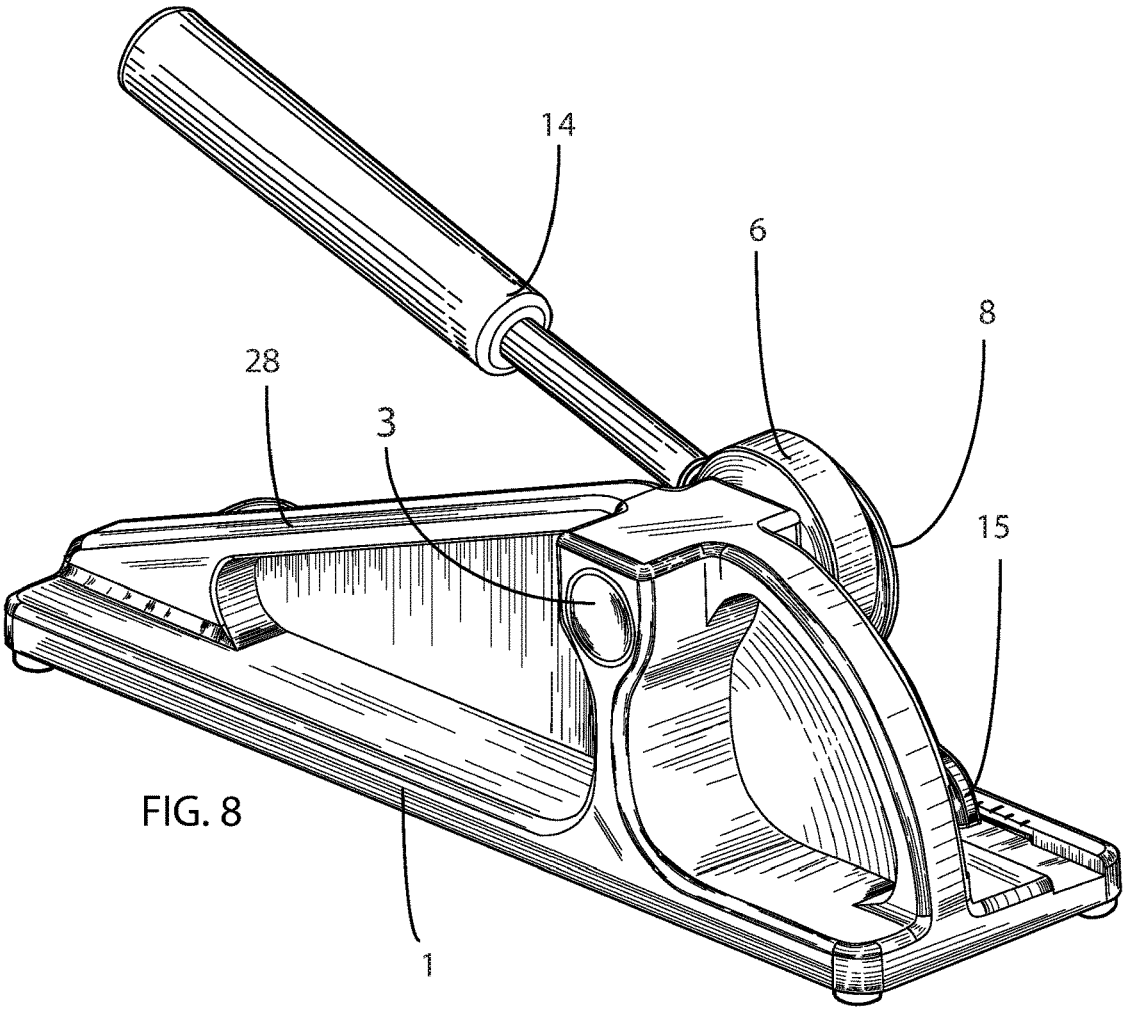
FIG. 8 is a back-perspective view of a fully assembled skate blade bending apparatus in accordance with an embodiment of the invention.
Figure 9:
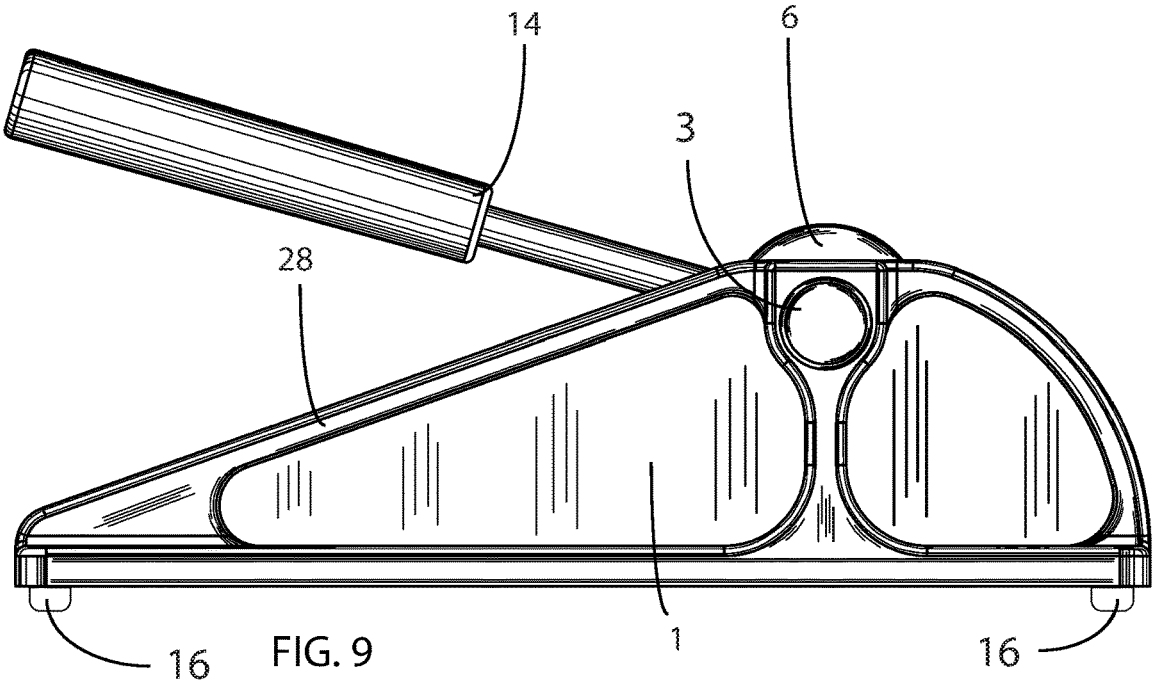
FIG. 9 is a view of the back of a fully assembled skate blade bending apparatus in accordance with an embodiment of the invention.
Figure 10:
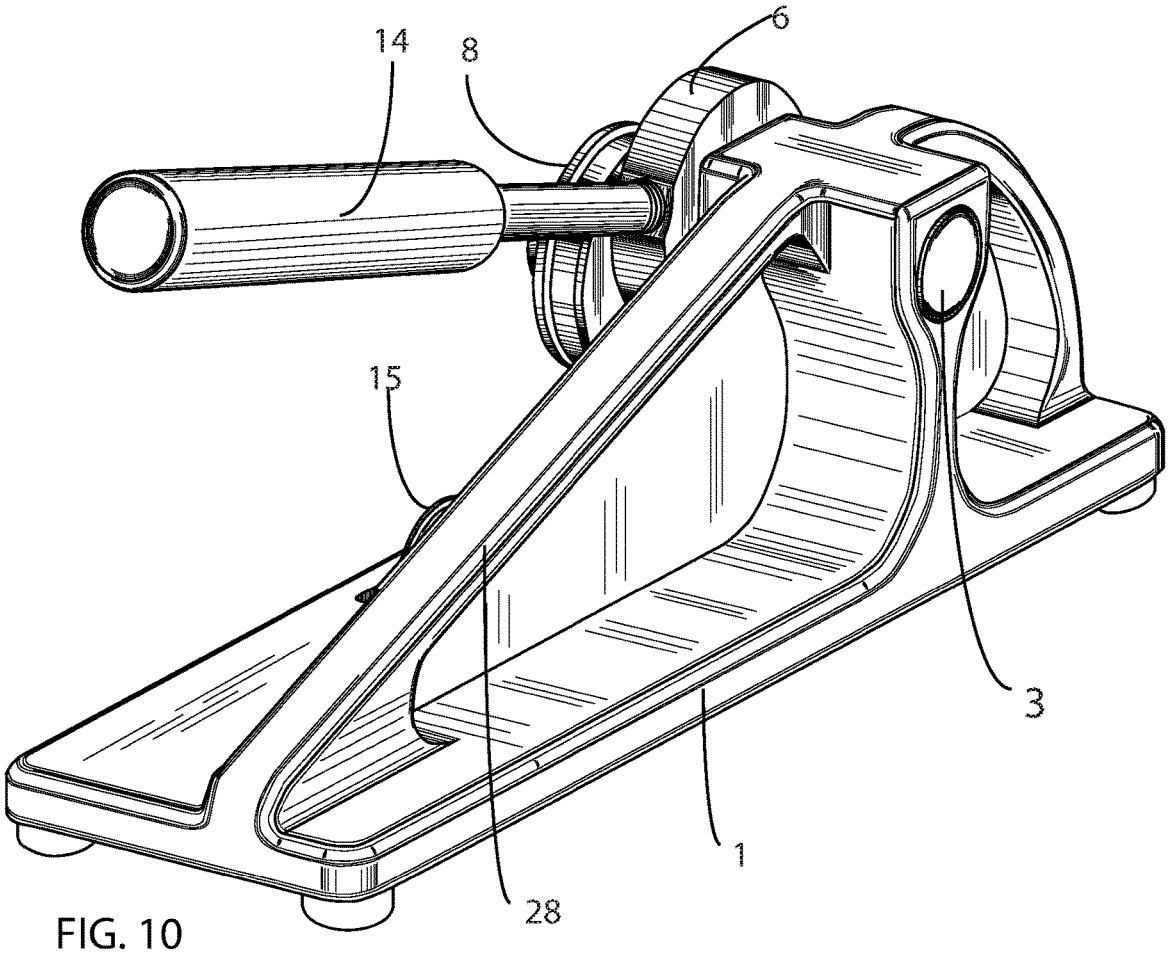
FIG. 10 is an alternate perspective view of the back of a fully assembled skate blade bending apparatus in accordance with an embodiment of the invention.
Figure 11:
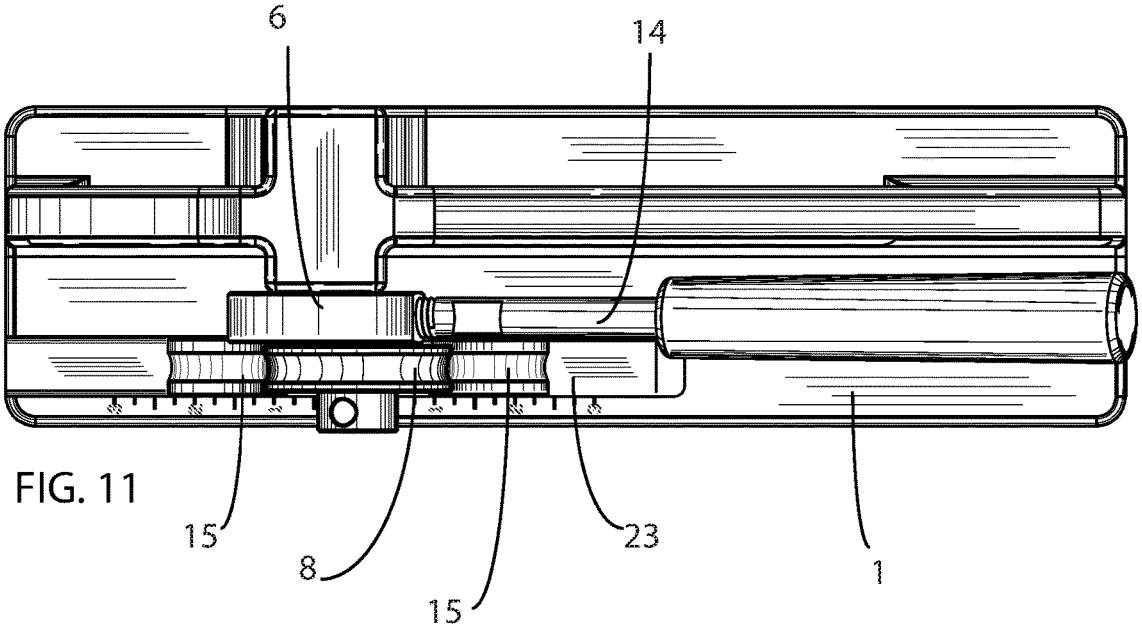
FIG. 11 is a top view of a fully assembled skate blade bending apparatus in accordance with an embodiment of the invention.
Figure 12:
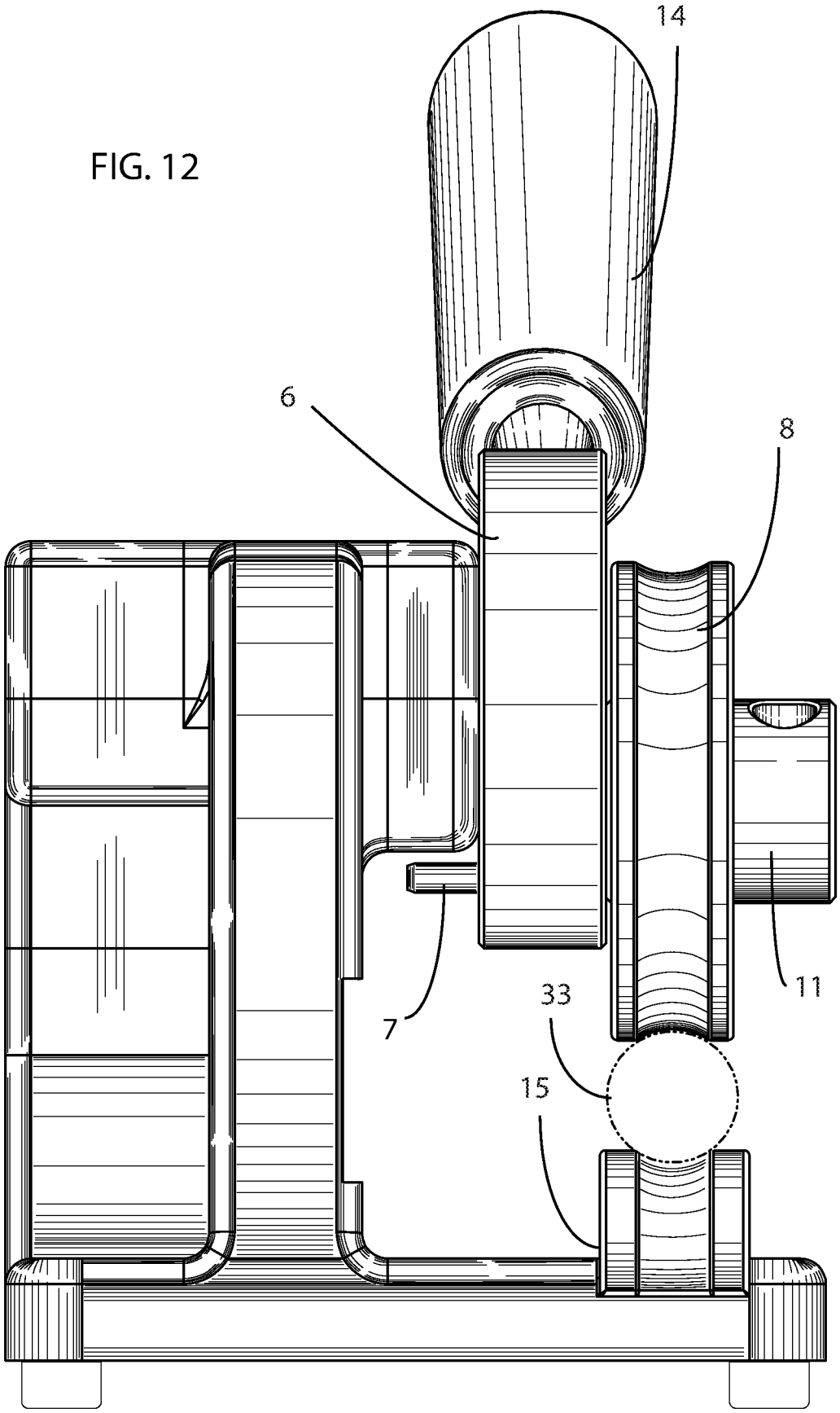
FIG. 12 is a side view of a fully assembled skate blade bending apparatus in accordance with an embodiment of the invention.
Figure 13:
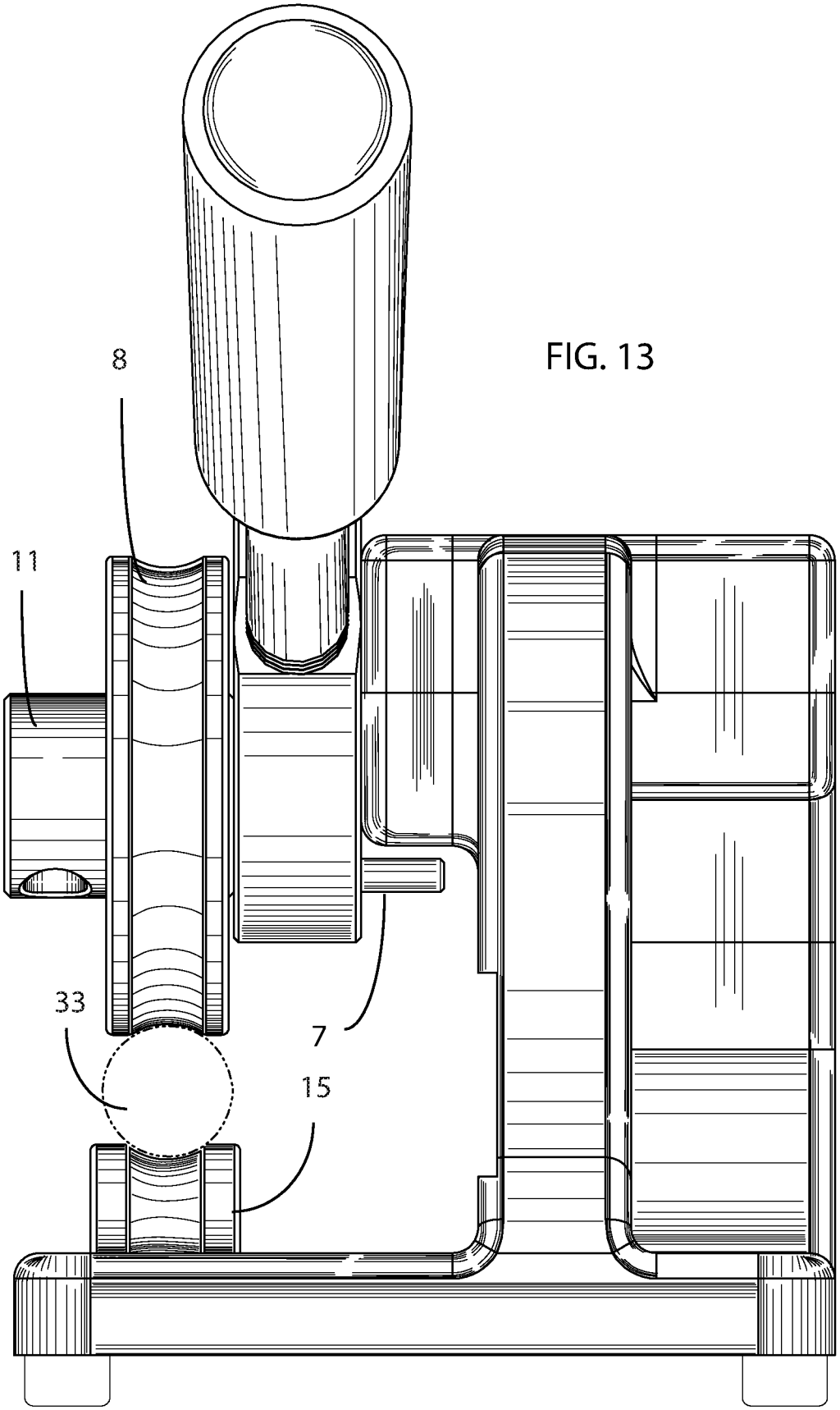
FIG. 13 is an alternate side view of a fully assembled skate blade bending apparatus in accordance with an embodiment of the invention.
Figure 14:
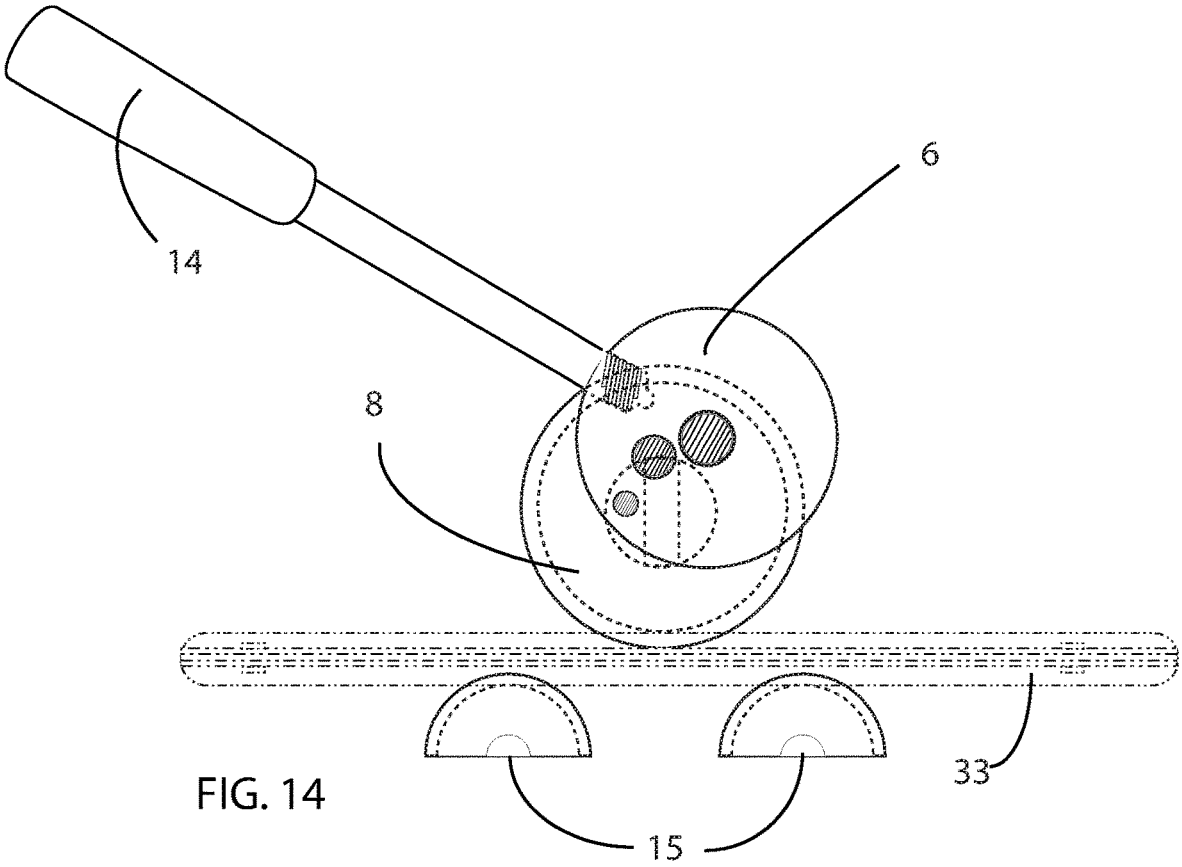
FIG. 14 is a partial cross-sectional view with sections removed, illustrates a skate blade being bent by some of the components of the skate blade bending apparatus shown throughout the FIGS.
Figure 15:
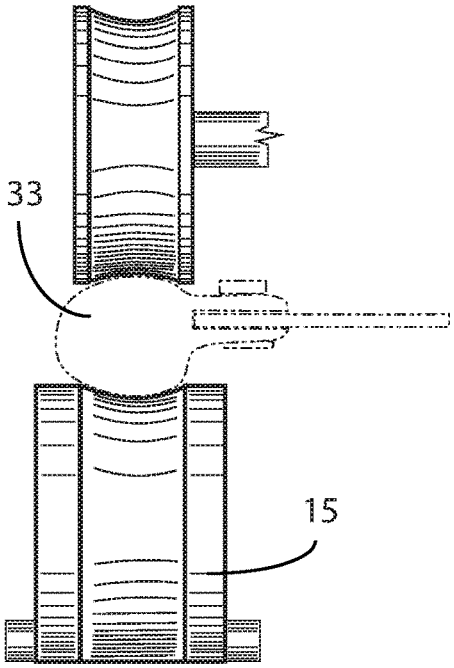
FIG. 15 is a partial front view with sections removed, illustrates a skate blade being squeezed between presser and anvil components, part of the skate blade bending apparatus shown throughout the FIGS.

While applying pressure to adjustable lever arm assembly (14), the user can use a hand grip rail (28) on the top back side of main body (1), as shown in FIGS. 8, 9, and 10. The hand grip rail allows for additional feedback to the user with respect to the amount of force being applied to the lever arm. The hand grip rail (28) can also be used to carry the blade bender apparatus.

There are various possibilities regarding the adjustable lever arm concept. Below is a listing of some alternate ways to accomplish an adjustable lever arm:

Lever arm (12) can have a female slot and lever arm handle (13) a matching male ridge and a set-screw, thereby allowing the handle (13) to slide along the lever arm (12) to the desired length and then be locked in place with the set screw.

Lever arm (12) can have a female detent divot and lever arm handle (13) a matching male detent spring and ball mechanism, thereby allowing the handle (13) to be moved to various positions allow the length of lever arm (12) and locked in place by the spring and ball mechanism.

Lever arm (12) and lever arm handle (13) can have a rack and pinion assembly and a battery-operated micro-servo motor to move the handle in and out along the length of lever arm (12) to the desired user location.

Figure 16:
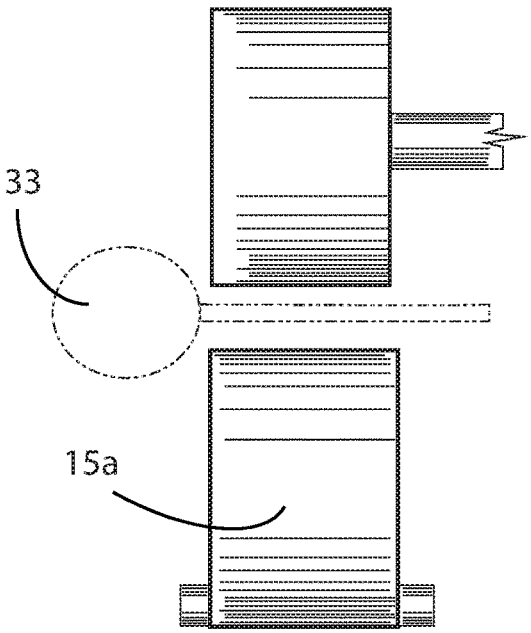
FIG. 16 is a perspective view of the front of an alternate configuration of the anvil component of a skate blade bending apparatus in accordance with an embodiment of the invention.

Anvils (15) and presser wheel (8) with a concave profile may be exchanged with profiles that are smooth and flat (15*a*) as shown in FIG. 16 to allow bending operations on the flat blade runner attachment surface to allow easier bending of the skate blade across the entire length of the blade if desired.

Figure 17:
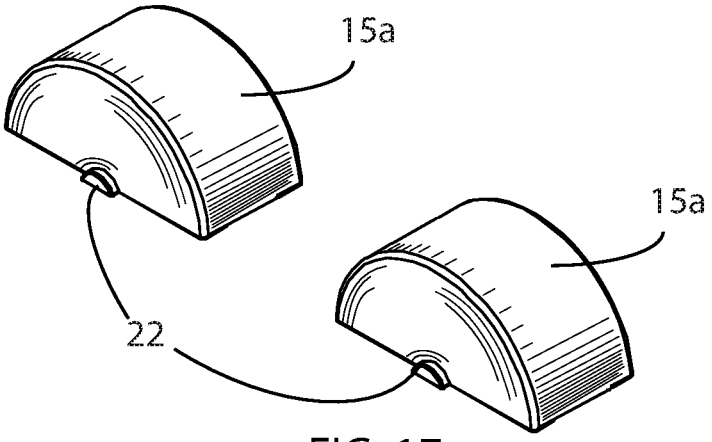
FIG. 17 is a perspective view of the front of an alternate configuration of the anvil component of a skate blade bending apparatus in accordance with an embodiment of the invention.
Figure 18:
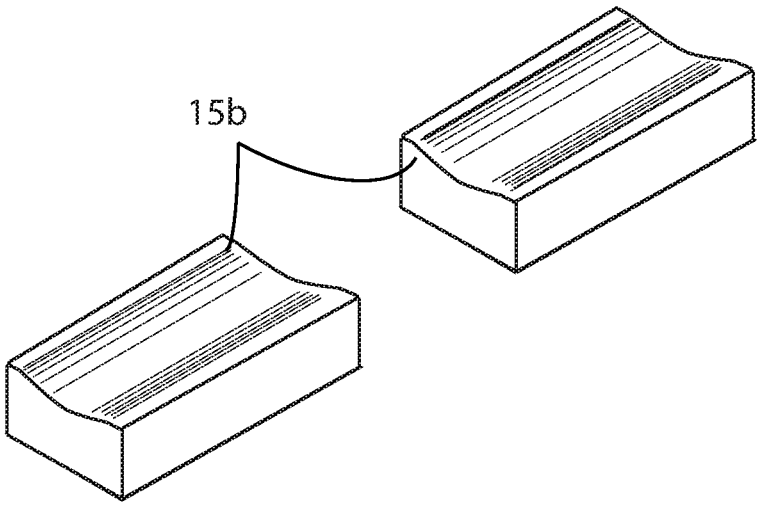
FIG. 18 is a perspective view of the front of a further alternate configuration of the anvil component of a skate blade bending apparatus in accordance with an embodiment of the invention.

If a user has blades that do not properly fit in the radius of the anvils (15) and presser wheel (8), these parts can be easily exchanged for alternate components with different radii, half radius, flat shapes, etc. as shown in FIG. 16-18. The examples shown in FIG. 17 (15*a*) and FIG. 18 (15*b*) are only a subset of possible shapes and should in no way be viewed as limiting.

The anvils (15) and presser wheel (8) can be surfaced with a different material, for example, rubber, plastic, etc. so as not to mar or damage the skate blades surface finish. The anvils (15) and the presser wheel (8) can be of diverse sizes and shapes. Varied materials, sizes, and interconnections can be used for all components.

Accordingly, the reader will see that the blade bending apparatus of the various embodiments can be used to provide an easy, precise, convenient, and repeatable method to bend skate blades of various shapes and configurations, over as much, or as little, of the blades length as the user desires, that does not damage the skate blades, that is easily adjusted for bending operation and user configuration preferences, that is easily transported, that can be easily adapted to new blade designs without requiring replacement of the apparatus, and that has an attractive appearance.

From the description above, many advantages of some embodiments of our blade bender apparatus become evident:

(a) The one-piece construction of the main body (1) allows for reduced weight and substantially increased strength. There is little possibility of the main body (1) failing with use.

(b) The independently positionable anvils (15) allow for greater breath of adjustment in how bending operations are performed.

(c) The removable and replaceable anvils (15) and presser wheel (8), with different shape possibilities, allow the bender to be used with all current and future skate blade designs without requiring the replacement of the apparatus.

(d) The graduation marks allow for easily repeatable bending operations.

(e) The open design of main body (1) combined with recessed area (27) allows users to work easily and quickly on assembled skates without risk of damage to the blades' runner surface.

(f) The adjustable lever arm assembly (14) allows users to easily adjust the pressure generated by the lever arm to tailor the device to their needs.

(g) The built-in hand grip rail (28) on the main body (1) allows for additional operator feedback during use of lever arm assembly (14) for more precise pressure application.

(h) The built-in hand grip rail (28) on the main body (1) allows for safe and easy one-handed transportation of the bender when it needs to be moved.

Although the description above contains many specificities, these should not be construed as limiting the scope of the embodiments but as merely providing illustrations of some of the several embodiments. For example, the main body can have other shapes, such as circular, trapezoidal, triangular, etc.; the lever arm mount and anvils can likewise have other shapes, etc. Thus, the scope of the embodiments should be determined by the appended claims and their legal equivalents, rather than by the examples given.

INDUSTRIAL APPLICABILITY

The present invention may be manufactured and used in industry, with a primary purpose of being used in the ice-skating industry.

We claim:

1. A bending apparatus for bending a skate blade, where the skate blade comprises a lengthened rail-type support and a blade runner component, said bending apparatus is comprised of:

a one-piece main body structure having top, bottom, front, and back with an upper ridge in the back of the main body structure;

a variably positionable securement structure along the front of the main body structure to selectively attach the skate blade to the main body structure such that a longitudinal axis of the skate blade runs substantially parallel to the ground, the securement structure being repeatably locatable relative to the main body structure; and a means for exerting downward force, attached to the main body structure so as to exert bending pressure on the skate blade in a force direction that is generally perpendicular to the blade's longitudinal axis at a predetermined location wherein, the ridge provides a structure for providing tactile user feedback on the bending pressure generated by the force exerting means during single-handed operation and also a handle for convenient transport of the apparatus.

2. The bending apparatus of claim 1, the means for exerting downward force being a lever with a presser assembly, the presser assembly also serving as at least a part of the securement structure.

3. The bending apparatus of claim 2, the lever assembly being adjustable for the optimization of mechanical advantage.

4. The bending apparatus of claim 1, the main body structure further comprising a generally concave area horizontally adjacent to the means for exerting downward force and the securement structure to prevent contact and damage to the skate blade.

5. The bending apparatus of claim 1, wherein the securement structure comprises a pair of restraining anvils which can be positioned at a user defined location, and at a user defined width apart, under the means for exerting downward force and along the longitudinal axis of the said skate blade.

6. The bending apparatus of claim 5, wherein the pair of anvils and the means for exerting downward force are easily interchangeable with optimally conforming shaped component parts to provide adaptability for differently shaped blades.

7. The bending apparatus of claim 5, further comprising a positioning scale wherein the anvils are capable of being precisely positioned at repeatable locations along the blade's longitudinal axis.

8. The bending apparatus of claim 5, wherein the securing means are attached to the main body structure by an easy to operate means of insertion and removal into the main body structure.

* * * * *